US008182437B2

(12) United States Patent
Gasbarro et al.

(10) Patent No.: US 8,182,437 B2
(45) Date of Patent: May 22, 2012

(54) PNEUMATIC COMPRESSION THERAPY SYSTEM AND METHODS OF USING SAME

(75) Inventors: James Gasbarro, Pittsburgh, PA (US); Carol Lynn Wright, Pittsburgh, PA (US)

(73) Assignee: Wright Therapy Products, Inc., Oakdale, PA (US)

( * ) Notice: Subject to any disclaimer, the term of this patent is extended or adjusted under 35 U.S.C. 154(b) by 1414 days.

(21) Appl. No.: 11/745,700

(22) Filed: May 8, 2007

(65) Prior Publication Data

US 2008/0281240 A1 Nov. 13, 2008

(51) Int. Cl.
*A61H 7/00* (2006.01)
*A61H 19/00* (2006.01)

(52) U.S. Cl. ..... 601/150; 601/148; 601/149; 137/884

(58) Field of Classification Search ..... 601/148–152, 601/10, 11, 41, 44, 15; 602/13, 62, 75–77; 137/884

See application file for complete search history.

(56) References Cited

U.S. PATENT DOCUMENTS 3,811,431 A * 5/1974 Apstein ..... 601/150
4,013,069 A 3/1977 Hasty
4,086,920 A 5/1978 Miniere
4,338,923 A 7/1982 Gelfer et al.
4,762,121 A 8/1988 Shienfeld
4,773,397 A 9/1988 Wright et al.
4,865,020 A 9/1989 Bullard
4,922,893 A 5/1990 Wright et al.
5,014,681 A 5/1991 Neeman et al.
5,117,812 A 6/1992 McWhorter
5,263,473 A 11/1993 McWhorter
5,307,791 A * 5/1994 Senoue et al. ..... 601/150
5,383,842 A * 1/1995 Bertini ..... 601/151
5,437,610 A 8/1995 Cariapa et al.
5,496,262 A 3/1996 Johnson, Jr. et al.
5,591,200 A 1/1997 Cone et al.
5,830,164 A 11/1998 Cone et al.
5,843,007 A 12/1998 McEwen et al.
5,891,065 A 4/1999 Cariapa et al.
5,968,073 A 10/1999 Jacobs
6,007,559 A 12/1999 Arkans
6,010,471 A 1/2000 Ben-Noon
6,080,120 A 6/2000 Sandman et al.
6,135,116 A 10/2000 Vogel et al.
6,179,796 B1 1/2001 Waldridge
6,231,532 B1 5/2001 Watson et al.
6,296,617 B1 10/2001 Peeler et al.
6,315,745 B1 11/2001 Kloecker
6,406,445 B1 6/2002 Ben-Nun
6,436,064 B1 8/2002 Kloecker
6,440,093 B1 8/2002 McEwen et al.

(Continued)

*Primary Examiner* — Justine Yu
*Assistant Examiner* — Colin W Stuart
(74) *Attorney, Agent, or Firm* — Pepper Hamilton LLP

(57) ABSTRACT

Pneumatic compression devices and methods for using the same are disclosed. A pneumatic compression device may include a compression pump, a fill/exhaust valve, a transducer, a plurality of cell valves, and a controller. The compression pump may output a pressurized fluid via an output. The fill/exhaust valve may connect one or more cell valves to the compression pump when in an open state and to the atmosphere when in a closed state. The transducer may sense a pressure level. Each cell valve may correspond to a cell and may connect the fill/exhaust valve to the corresponding cell when in an open state. The controller may determine a state (either open or closed) for each of the fill/exhaust valve and the plurality of cell valves based on at least the pressure level sensed by the transducer.

12 Claims, 5 Drawing Sheets

U.S. PATENT DOCUMENTS 6,494,852 B1 12/2002 Barak et al.
6,558,338 B1 5/2003 Wasserman
6,645,165 B2 11/2003 Waldridge et al.
6,736,787 B1 * 5/2004 McEwen et al. ..... 601/152
6,786,879 B1 9/2004 Bolam et al.
6,846,295 B1 1/2005 Ben-Nun
6,852,089 B2 2/2005 Kloecker et al.
6,860,862 B2 3/2005 Waldridge et al.
6,893,409 B1 5/2005 Lina
6,945,944 B2 9/2005 Kuiper et al.
6,966,884 B2 11/2005 Waldridge et al.
7,063,676 B2 6/2006 Barak et al.
2004/0171971 A1 * 9/2004 Ravikumar et al. ..... 601/32
2005/0222526 A1 * 10/2005 Perry et al. ..... 601/152
2006/0272719 A1 * 12/2006 Steinberg ..... 137/884
2007/0088239 A1 * 4/2007 Roth et al. ..... 601/152

* cited by examiner

PNEUMATIC COMPRESSION THERAPY SYSTEM AND METHODS OF USING SAME

BACKGROUND

1. Technical Field

The disclosed embodiments generally relate to systems and methods for providing compression therapy. More particularly, the disclosed embodiments relate to systems and methods for applying intermittent compression to portions of a body part.

2. Background

Diseases such as lymphedema and venous insufficiency can often result in the pooling of bodily fluids in areas of the body distal from the heart. Venous insufficiency can result when the superficial veins of an extremity empty into the deep veins of the lower leg. Normally, the contractions of the calf muscles act as a pump, moving blood into the popliteal vein, the outflow vessel. Failure of this pumping action can occur as a result of muscle weakness, overall chamber size reduction valvular incompetence and/or outflow obstruction. Each of these conditions can lead to venous stasis and hypertension in the affected area.

Fluid accumulation can be painful and debilitating if not treated. Fluid accumulation can reduce oxygen transport interfere with wound healing, provide a medium that support infections or even result in the loss of a limb if left untreated.

Compression pumps are often used in the treatment of venous insufficiency by moving the accumulated bodily fluids. Such pumps typically include an air compressor, an appliance, such as a sleeve that is fitted over a problem area, and control circuitry governing mechanical components that cause the appliance to inflate and exhaust in a predetermined manner. The appliance typically includes a plurality of cells. Each cell can be independently inflated. The cells are typically arranged in a linear fashion along the limb and are inflated sequentially to promote the movement of fluid from the distal portion of the extremity toward the body core. This fluid movement serves to relieve pain and pressure associated with the edema. Exemplary devices are shown in U.S. Pat. No. 6,494,852 to Barak et al and U.S. Pat. No. 6,315,745 to Kloecker, each of which is incorporated herein by reference in its entirety.

In order to inflate the cells of the appliance, a compression pump typically includes a plurality of ports. Each port is connected to a cell of the appliance via a tube. Each port is capable of inflating the corresponding cell to a predetermined pressure, maintaining the cell at the predetermined pressure for a period of time and then reducing the pressure in the cell until atmospheric pressure is achieved. This process of inflating, maintaining pressure and reducing pressure can require a plurality of solenoid controlled valves to direct air flow and a separate mechanism to accurately control cell pressure, such as a pressure regulation device (i.e., a regulator).

Valves and regulators can be costly items. As such, minimizing the number of such valves and regulators in the system can significantly reduce both the complexity and the cost of a pneumatic compression device.

Conventionally, pneumatic compression devices use compression pumps and pressure regulators to control pressures at a plurality of ports. FIG. 1 depicts a conventional pneumatic compression device. As shown in FIG. 1, the arrows symbolize the direction of air flow through the device. In such devices, the compression pump 105 is configured to supply pressurized fluid, such as pressurized air, via a plurality of conduits to a plurality of pressure regulators 110*a*-N. The pressure regulators 110*a*-N are used to reduce the pressure of the pressurized fluid to a lower pressure based on a mechanical setting of each regulator 110*a*-N. A valve 115*a*-N corresponding to each regulator 110*a*-N can switchably connect a cell port to the corresponding regulator (i.e., the fluid at the regulated pressure) or the atmosphere (i.e., atmospheric pressure) as directed by a control processor 120. Typically, one control processor 120 can be used to control all valves 115*a*-N.

In operation, a first valve, such as 115*a*, for a particular cell port can be connected to a first regulator 110*a*. Switching the first valve 115*a* to be connected to the first regulator 110*a* can cause the fluid at the regulated pressure of the first regulator to inflate the cell port. The first regulator 110*a* can maintain the regulated pressure at the cell port as long as the valve 115*a* enables a connection between the first regulator and the cell port. For deflation, the first valve 115*a* can be closed to divert the pressurized fluid in the cell to the atmosphere. Other valves and their corresponding regulators operate in a substantially similar manner.

The pneumatic compression device shown in FIG. 1 is configured to enable each cell to be inflated and exhausted independently from every other cell. To do this, the pneumatic compression device of FIG. 1 requires a regulator 110*a*-N for each cell port. Moreover, because the regulators 110*a*-N are mechanical devices, the control processor 120 cannot directly set the pressure of the fluid. Rather, a user or care provider is typically responsible for ensuring that each regulator 110*a*-N is adjusted to provide pressurized fluid at an appropriate pressure.

Improved systems and methods for implementing and controlling a pneumatic compression device would be desirable.

SUMMARY

Before the present methods, systems and materials are described, it is to be understood that this disclosure is not limited to the particular methodologies, systems and materials described, as these may vary. It is also to be understood that the terminology used in the description is for the purpose of describing the particular versions or embodiments only, and is not intended to limit the scope.

It must also be noted that as used herein and in the appended claims, the singular forms "a", "an," and "the" include plural references unless the context clearly dictates otherwise. Thus, for example, reference to a "medicament" is a reference to one or more medicaments and equivalents thereof known to those skilled in the art, and so forth. Unless defined otherwise, all technical and scientific terms used herein have the same meanings as commonly understood by one of ordinary skill in the art. Although any methods, materials, and devices similar or equivalent to those described herein can be used in the practice or testing of embodiments, the preferred methods, materials, and devices are now described. All publications mentioned herein are incorporated by reference. Nothing herein is to be construed as an admission that the embodiments described herein are not entitled to antedate such disclosure by virtue of prior invention.

In an embodiment, a pneumatic compression device may include a compression pump, a fill/exhaust valve, a transducer, a plurality of cell valves, and a controller. The compression pump may be configured to output a pressurized fluid via an output. The fill/exhaust valve may be configured to connect the compression pump to one or more cell valves when in an open state and to connect the one or more cell valves to the atmosphere when in a closed state. The transducer may be configured to sense a pressure level at the fill/exhaust valve. Each cell valve may correspond to a cell and may be configured to connect the fill/exhaust valve to the corresponding cell when in an open state. The controller may be in communication with the transducer, the fill/exhaust valve and the plurality of cell valves. The controller may be configured to determine a state for each of the fill/exhaust valve and the plurality of cell valves based on at least the pressure level sensed by the transducer. Each state may include one of an open state and a closed state.

In an embodiment, a pneumatic compression device may include a compression pump configured to output a pressurized fluid via an output, and a manifold. The manifold may include a first bore, a second bore, a plurality of valves, and a plurality of spacers. A first valve may include a fill/exhaust valve. A plurality of second valves may include cell valves. Each valve may include a portion of the first bore and a portion of the second bore. Each spacer may be positioned on a distal side of a corresponding valve and may be operable to separate the portion of the second bore of the corresponding valve from the portion of the second bore of an adjacent valve or the atmosphere. A spacer corresponding to the fill/exhaust valve may be further operable to separate the portion of the first bore of the fill/exhaust valve from the portion of the first bore of the adjacent cell valve. Each valve may be configured to connect the corresponding portion of the first bore to a valve output when the valve is in a first state and to connect the corresponding portion of the second bore to the valve output when the valve is in a second state. The portion of the first bore corresponding to the fill/exhaust valve may be connected to the atmosphere. The portion of the second bore corresponding to the fill/exhaust valve may be connected to the output of the compression pump. The valve output of the fill/exhaust valve may be connected to the portion of the first bore of a cell valve.

In an embodiment, a method of operating a pneumatic compression device including a fill/exhaust valve, a plurality of cell valves connected to an output of the fill/exhaust valve, a compressor pump connected to a first port of the fill/exhaust valve, a controller, a transducer in communication with the controller, and a plurality of cells each connected to an output of a corresponding cell valve may include deflating the plurality of cells, inflating at least one cell until a second pressure threshold is achieved, determining whether to inflate one or more additional cells, and, if so, repeating the inflating and determining steps for the one or more additional cells. Deflating the plurality of cells may include placing the fill/exhaust valve in an exhaust state, and placing each cell valve in an open state until a first pressure threshold is achieved. Inflating at least one cell may include placing the fill/exhaust valve in a fill state, placing one or more cell valves corresponding to the at least one cell in an open state, and placing cell valves not corresponding to the at least one cell in a closed state.

BRIEF DESCRIPTION OF THE DRAWINGS

Aspects, features, benefits and advantages of the embodiments described herein will be apparent with regard to the following description, appended claims and accompanying drawings where:

DETAILED DESCRIPTION

Figure 1:
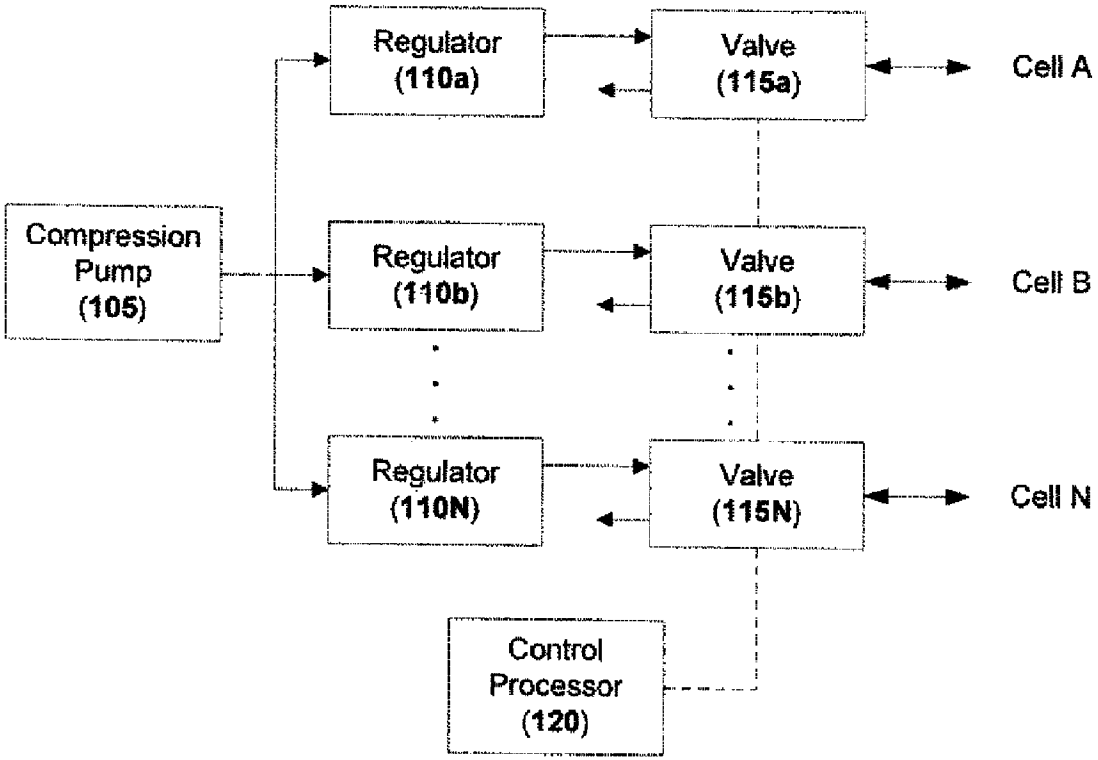
Figure 1 (Prior Art)
FIG. 1 depicts a pneumatic compression device according to the known art.
Figure 2:
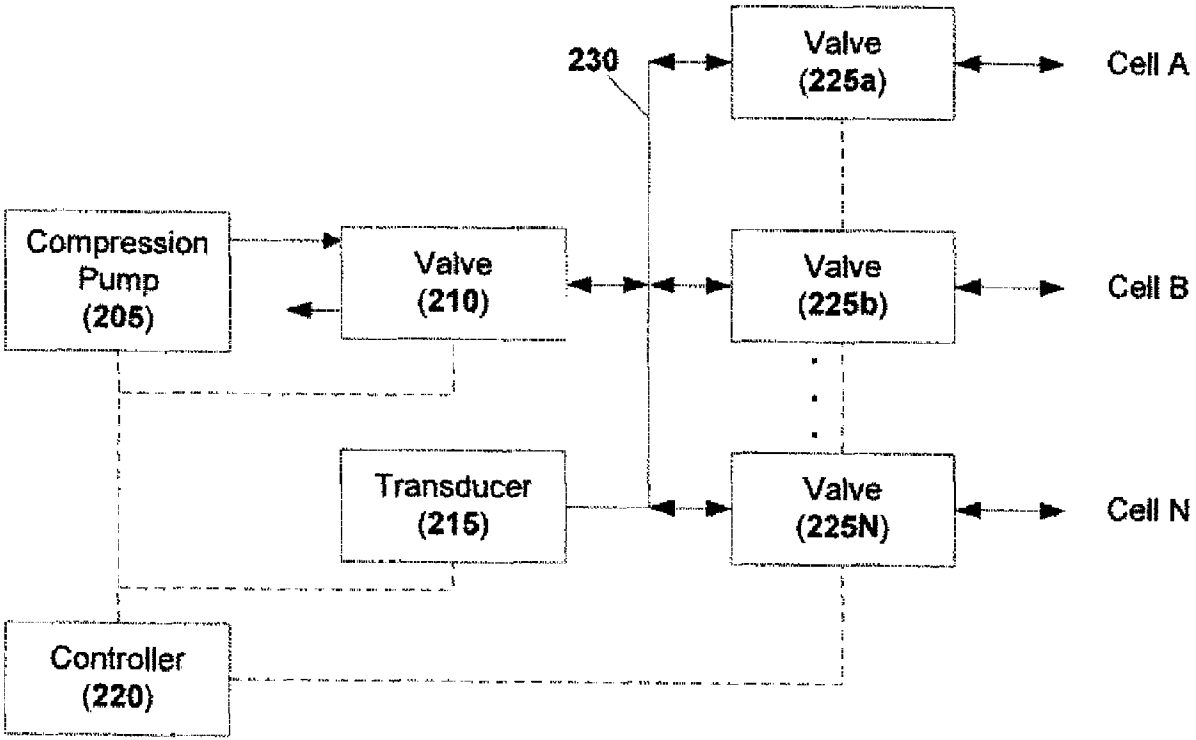
FIG. 2 depicts an exemplary pneumatic compression device according to an embodiment.

FIG. 2 depicts an exemplary pneumatic compression device according to an embodiment. As shown in FIG. 2, the pneumatic compression device may include a compression pump 205, a fill/exhaust valve 210, a transducer 215, a controller 220 and a plurality of cell valves, such as 225*a*-N. The compression pump 205 may be used to provide a pressurized fluid. The fill/exhaust value 210 may be connected to the compression pump 205 to receive the pressurized fluid. During an inflation period, the fill/exhaust valve 210 may be used to connect the output of the compression pump 205 to a common node or manifold 230. During a deflation period, the fill/exhaust valve 210 may connect the common manifold 230 to, for example, the atmosphere. Each of the cell valves 225*a*-N may be connected to the common manifold 230 on a first side and a corresponding cell on a second side. Each cell valve 225*a*-N may be used to selectively connect or disconnect the corresponding cell to the common manifold 230.

The transducer 215 may be connected to and used to monitor the pressure on the common manifold 230. The controller 220 may receive information regarding the pressure detected by the transducer 215. Based on at least the received pressure information, the controller 220 may determine whether to open or close the fill/exhaust valve 210 and/or one or more of the cell valves 225*a*-N.

In an embodiment, the transducer 215 may have a transfer function associated with it which is used to determine the input pressure monitored at the common manifold 230. For example the transfer function for an MPX5050 transducer manufactured by Motorola may be $V_O=V_S*(0.018*P+0.04)+$ Offset Error, where $V_O$ is the output voltage, $V_S$ is the supply voltage (which may be, for example, approximately 5 Volts), P is the input pressure as measured in kPa, and Offset Error is a static voltage value that is dependent on the process, voltage and temperature of the transducer. Solving for the pressure and combining the Offset Error and $0.04V_S$ term results in the following equation:

$$P(kPa) = \frac{55.6*(V_O - V_{offset})}{V_S} \tag{1}$$

Equation (1) may also be represented in terms of mm Hg by converting 1 kPa to 7.5 mm Hg. The resulting equation is the following:

$$P(\text{mmHg}) = \frac{417*(V_O - V_{offset})}{V_S} \tag{2}$$

The transducer 215 may then be calibrated to determine the pressure based on the output voltage. Initially, $V_{offset}$ may be determined by closing all of the cell valves 225*a*-N and venting the common manifold 230 to the atmosphere via the fill/exhaust valve 210. A value determined by an analog-to-digital (A/D) converter that may either be in communication with or integral to the transducer 215 may be read when the transducer is under atmospheric pressure. The value output by the A/D converter may be an offset value (OFFSET). For a 12-bit A/D converter, OFFSET may be between 0 and 4095.

A scale value (SCALE) may also be determined that corresponds to a scaled source voltage. For example, a precision resistor divide-by-two circuit may be used to divide $V_S$ by 2. The A/D converter may output SCALE based on the $V_S/2$ input value. For a 12-bit A/D converter, SCALE may be a value between 0 and 4095.

Substituting OFFSET and SCALE into Equation (2) results in the following equation:

$$P(\text{mmHg}) = \frac{208.5 * (\text{TRANSDUCER_OUTPUT} - \text{OFFSET})}{\text{SCALE}}. \quad (3)$$

As such, the offset error and the scale error of the transducer 215 and any errors in the transducer supply voltage may be accounted for by measuring the OFFSET and SCALE values once (for example, at power up).

Alternate transducers potentially having different transfer functions may also be used within the scope of the present disclosure as will be apparent to one of ordinary skill in the art. In addition, one of ordinary skill in the art will recognize that alternate methods of calibrating a transducer may be performed based on the teachings of the present disclosure.

Figure 3:
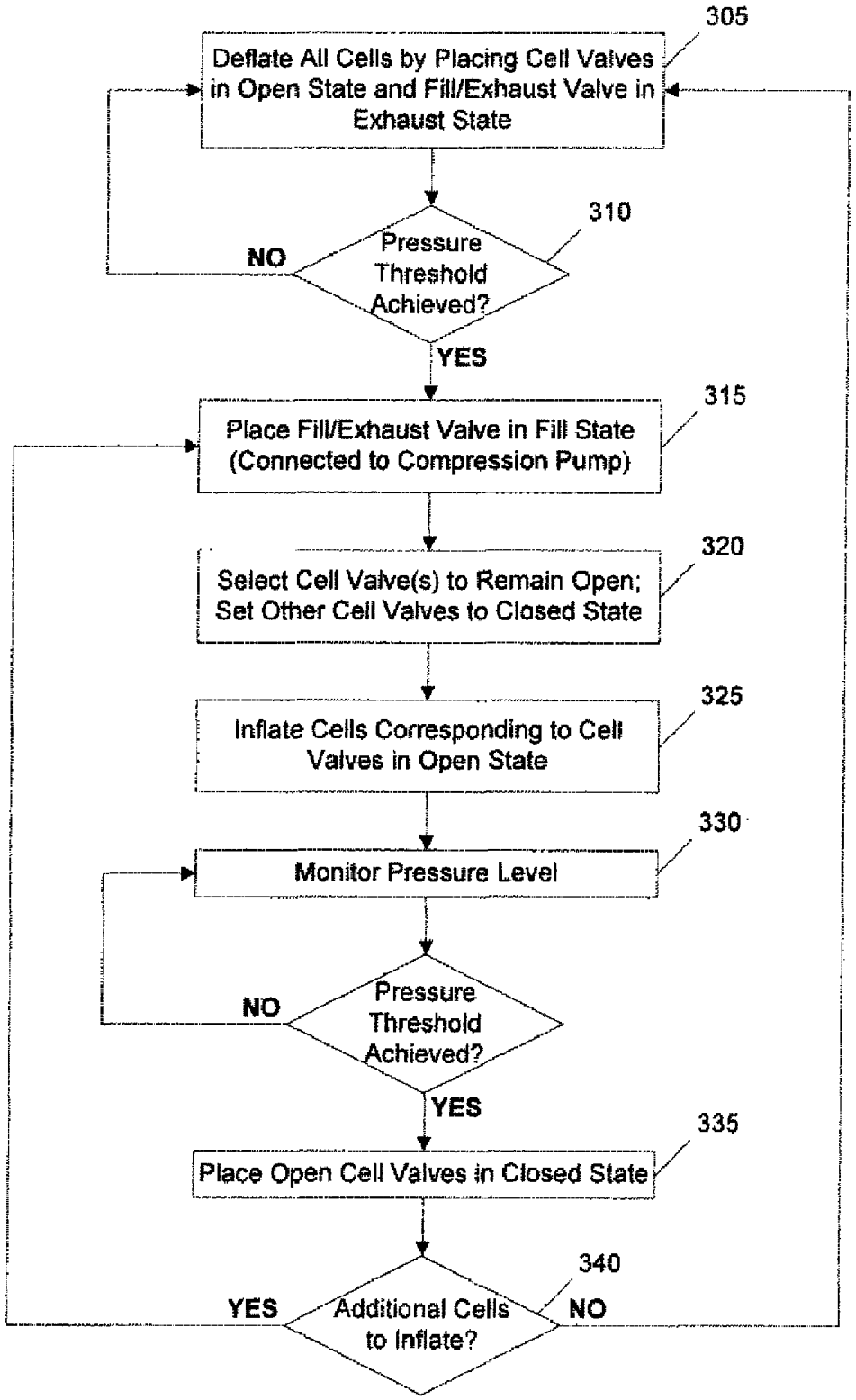
FIG. 3 depicts a flow diagram of an exemplary method of using a pneumatic compression device according to an embodiment.

FIG. 3 depicts a flow diagram of an exemplary method of using a pneumatic compression device according to an embodiment. Initially, all cells may be deflated 305 by opening each of the cell valves 225*a*-N (i.e., placing each cell value in a state in which the corresponding cell is connected to the common manifold 230) and venting the common manifold to the atmosphere via the fill/exhaust valve 210. The controller 220 may determine 310 whether a minimum pressure threshold has been reached based on information received from the transducer 215. When the minimum pressure threshold is reached, the controller 220 may initiate an inflation cycle by causing 315 the fill/exhaust valve 210 to connect the compression pump 205 and the common manifold 230.

One or more cell valves 225*a*-N may be opened or remain open 320 when the fill/exhaust valve 210 causes 315 the compression pump 205 and the common manifold 230 to be connected. In an embodiments a cell valve, such as 225*a*, connected to a distal cell may be opened or remain open 320, and all other cell valves may be closed (i.e., in a state in which the corresponding cell is not connected to the common manifold 230). The cell connected to the open cell valve 225*a* may inflate 325 as a result of being connected to the pressurized fluid from the compression pump 205. The cell pressure may be monitored 330 by the controller 220 via the transducer 215.

In an embodiment, an opened cell valve, such as 225*a*, may be modulated to control the fill rate of the corresponding cell. The opened cell valve may be modulated based on time and/or pressure. For example, a cell valve that is being modulated on a time basis may be opened for a first period of time and closed for a second period of time as the cell is inflating 325. Alternately, a cell valve that is being modulated on a pressure basis may be opened while the cell pressure increases by an amount and closed for a period of time as the cell is inflating 325. The pressure increase may be determined by measuring an initial cell pressure before opening the cell valve and the cell pressure as the cell valve is open. When the difference between the initial cell pressure and the cell pressure is substantially equal to the amount, the cell valve may be closed. The duty cycle at which the cell valve is modulated may be any value. The controller 220 may determine when to open and close the cell valve. For pressure-based modulation, the transducer 215 may provide pressure data to the controller 220 to assist in determining when to open and/or close the cell valve during modulation.

Modulation may be performed to ensure that the cell pressure does not increase too quickly, which could cause pain to a patient receiving treatment. Moreover, cells may be of varying size. For example, cells in a device designed for a child may be smaller than cells in a device designed for an adult. However, the compression pump 205 may have a relatively fixed flow rate. As much, modulation may be used to ensure that cell inflation is performed at a proper rate.

In an alternate embodiment, a cell valve, such as 225*a*, may include a variable aperture, which may be used to restrict the rate at which the pressure increases in the corresponding cell. In another alternate embodiment, a compression pump 205 that operates with a variable flow rate may be used. Additional methods of modulating pressure may also be performed and will be apparent to one of ordinary skill in the art based on this disclosure.

When the cell reaches an appropriate pressure, the controller 220 may close 335 the cell valve 225*a* corresponding to the cell. A determination may be made 340 as to whether another cell is to be connected to the compression pump 205. If so, the process may return to step 315 for the new cell. If not, the process may return to step 305 to release the pressure from all cells (i.e., all cell valves 225*a*-N may be opened and the fill/exhaust valve 210 may connect the common manifold 230 to the atmosphere).

In an embodiment, a plurality of cell valves 225*a*-N may be opened 320 simultaneously. As such, it may be possible to inflate 325 a plurality of cells simultaneously. As the pressure in each cell surpasses a corresponding threshold, the controller 220 may close 335 the cell valve 225*a*-N for the cell. In an embodiment, one or more cells may not be deflated during step 305. In such an embodiment, the controller 220 may only open 305 cell valves 225*a*-N corresponding to cells to be deflated.

In an embodiment using modulation, a plurality of cell valves 225*a*-N may be modulated simultaneously. At any given time, one or more cell valves may be opened and/or closed according to a modulation schedule. For example, for a time-based modulation scheme having a 50% duty cycle, half of the cell valves 225*a*-N may be open and half of the cell valves may be closed at any time.

In an embodiment, the amount of pressure sensed by the transducer 215 may differ from the cell pressure at a particular cell. For example, pressure losses may occur between the transducer 215 and a cell. Accordingly, the controller 220 may access a lookup table to determine the threshold at which the pressure sensed by the transducer 215 is appropriate to close the cell valve 225*a*-N corresponding to the cell.

In an embodiment, the pneumatic compression device may be portable. In an embodiment, the pneumatic compression device may include a user interface that enables the user to interact with the controller 220. For example, the user interface may include a display and one or more input devices, such as a keypad, a keyboard, a mouse, a trackball, a light source and light sensor, a touch screen interface and/or the like. The one or more input devices may be used to provide information to the controller 220, which uses the information to determine how to control the fill/exhaust valve 210 and/or the cell valves 225*a*-N.

In an embodiment the controller 220 may store and/or determine settings for each cell. For example, the controller 220 may determine one or more pressure thresholds for each cell and a sequence in which the cells are inflated or deflated.

Moreover, the controller 220 may prevent the pneumatic compression device from being used improperly by enforcing requirements upon the system. For example, if the controller 220 is constrained to implement a procedure in which distal cells are required to have higher pressure thresholds than proximal cells, the controller may override information received via the user interface that does not conform to such pressure threshold requirements. In an embodiment, the pressure thresholds of one or more cells may be adjusted to meet the pressure threshold constraints.

In an embodiment, the cell valves 225*a*-N may not be opened simultaneously when the cells are deflated 305, but rather may be opened in a staggered fashion. This may prevent a reverse gradient from being caused by cells sharing pressure via the common manifold 230. In an embodiment, when the cells are deflated 305, the fill/exhaust valve 210 may first be configured to vent the common manifold 230 to the atmosphere. In an embodiment, a first cell valve, such as 225*a*, may be opened to release the pressure in the corresponding cell. After a short period of time elapses, such as about 1 second, a second cell valve, such as 225*b*, may be opened to release the pressure in the corresponding cell. The process may be repeated until each cell valve 225*a*-N has been opened.

In an alternate embodiment, the cell valves 225*a*-N may be opened simultaneously. By opening the cell valves 225*a*-N simultaneously, a reverse gradient may not be formed in the affected area of the patient.

In an embodiment, the cell valves 225*a*-N may be opened in order from the cell valve corresponding to the cell having the highest pressure to the cell valve corresponding to the cell having the lowest pressure. In an embodiment, the controller 220 may direct each cell valve 225*a*-N to open when the pressure for the corresponding cell approximately matches the pressure of each cell for which the cell valve has previously been opened.

Figure 4:
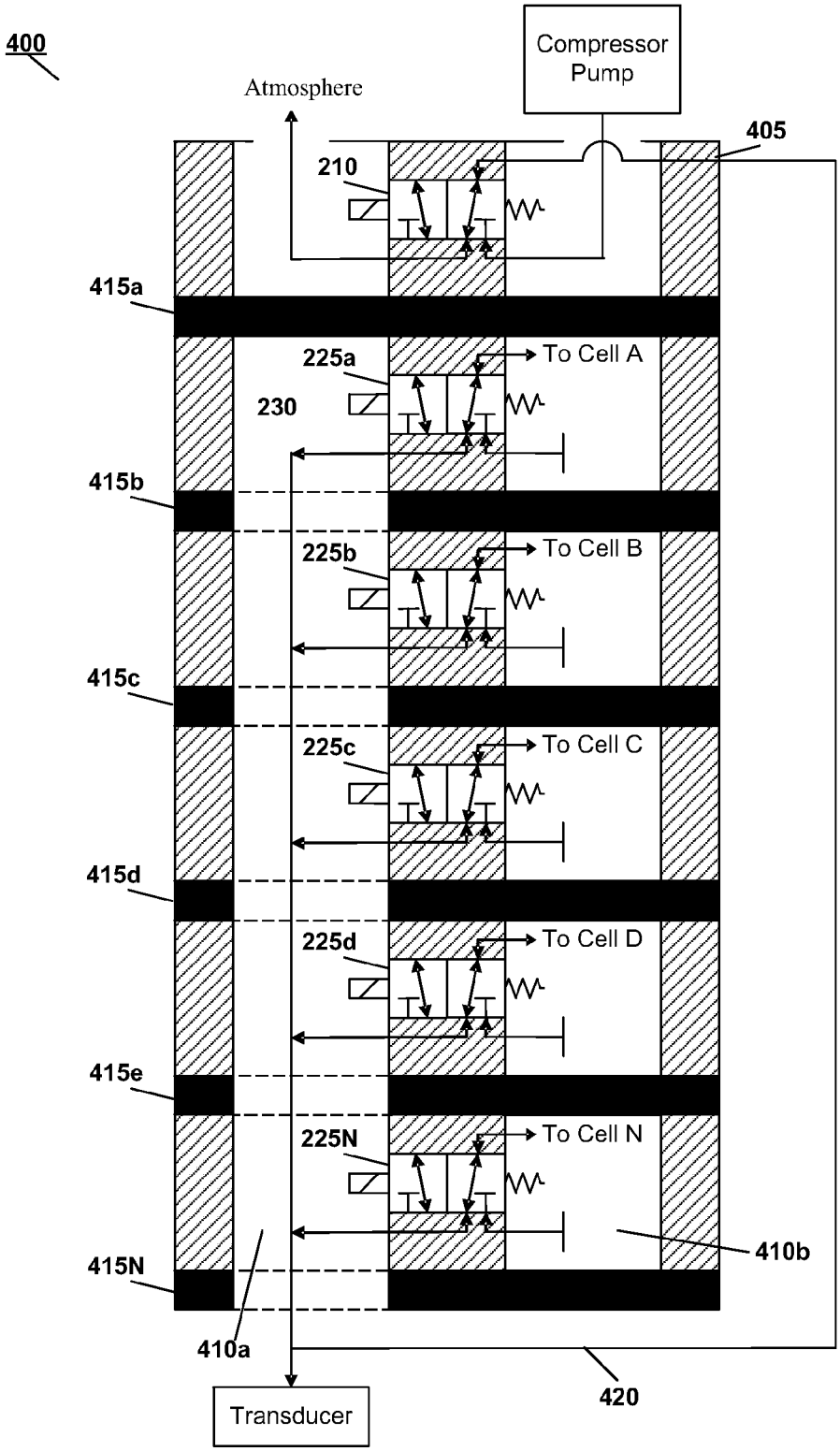
FIG. 4 depicts an exemplary manifold for use with a pneumatic compression device according to an embodiment.

FIG. 4 depicts an exemplary valve manifold for use with a pneumatic compression device according to an embodiment. The valve manifold 400 may include a plurality of valves, such as the fill/exhaust valve 210 and the cell valves 225*a*-N. Each valve may have a common port, such as 405, and, for example, two bores, such as 410*a* and 410*b*. When a valve is de-energized (i.e., turned off), the common port 405 may be connected to the first bore 410*a*. Conversely, when a valve is energized (i.e., turned on), the common port 405 may be connected to the second bore 410*b*.

Spacers 415*a*-N may be situated between valves. In an embodiment, the spacers may be made of plastic, metal or any other material that is impervious to air. In an embodiment, a first spacer 415*a* may be solid, and the remaining spacers 415*b*-N may each have a hole coincident with the first bore 410*a*. As such, the cell valves 225*a*-N may be connected to a common manifold 230. The spacers 415*a*-N may enable the fill/exhaust valve 210 to be contained within the body of the manifold 400. Otherwise, the fill/exhaust valve 210 would have to be a separate valve. The spacers 415*a*-N may also be used to prevent the pressure in the second bore 410*b* from passing to an adjoining valve 225. As such, each cell may maintain an individual pressure.

When power is removed, the cells may be connected through their respective cell valves 225*a*-N to the common manifold 230. The common manifold 230 may be connected via, for example, external tubing 420 to the common port of the fill/exhaust valve 210. When power is removed, the common port of the fill/exhaust valve 210 may be vented to the atmosphere.

In order to fill a cell, the fill/exhaust valve 210 may be energized. As such, the compression pump 205 may pressurize the common manifold. If a cell valve, such as 225N, is desired to be filled, the cell valve may remain de-energized. If a cell valve, such as 225*a*, is not desired to be filled, the cell valve may be energized. As such, the desired cell(s) may remain connected to the common manifold 230, while the other cells may be blocked from the common manifold and may retain their pressure. As the desired cell(s) fill, the pressure may be monitored using the transducer 215, which is also connected to the common manifold 230. When the desired pressure is reached for a particular cell, the corresponding cell valve 225 may be energized. If additional cells are to be pressurized, the process may be repeated by de-energizing the corresponding cell valve 225.

Figure 5:
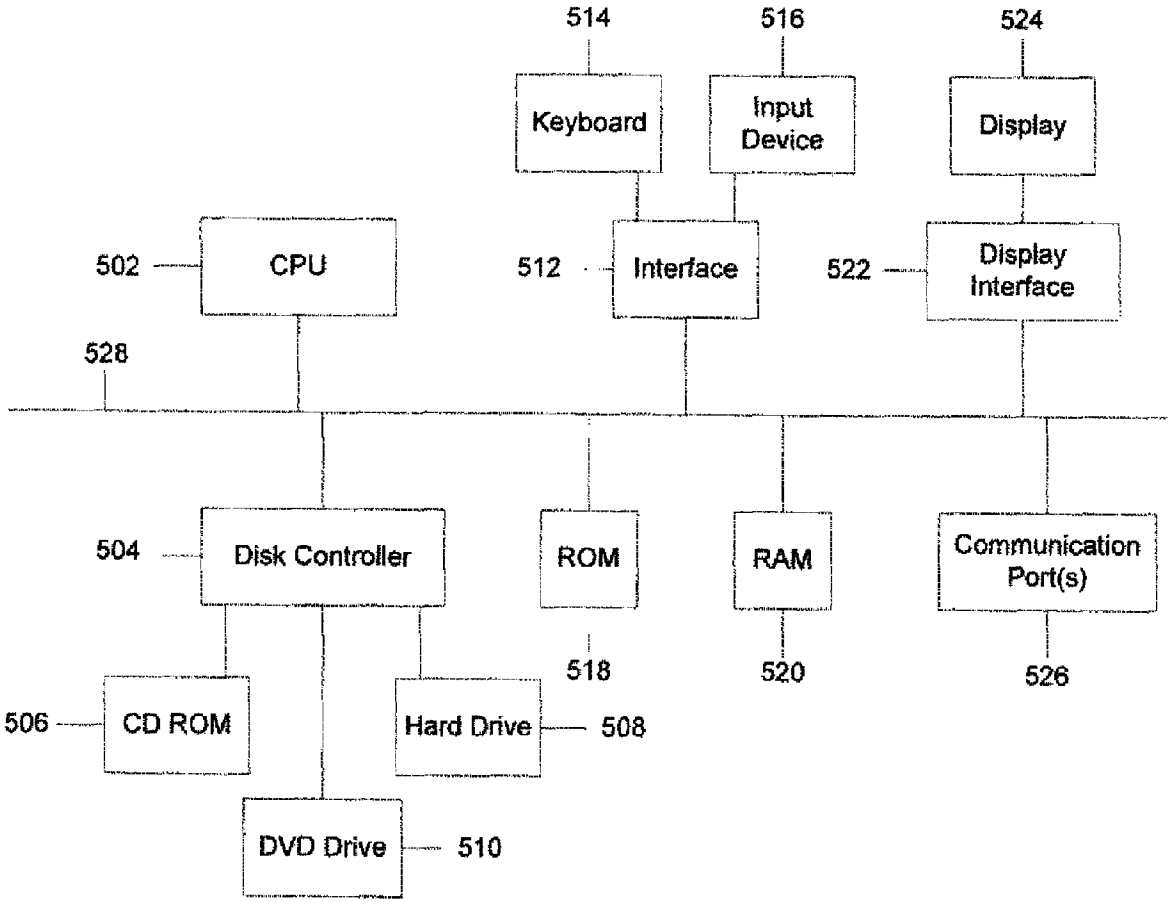
FIG. 5 is a block diagram of exemplary hardware that may be used to contain or implement program instructions according to an embodiment.

FIG. 5 is a block diagram of exemplary hardware that may be used to contain or implement program instructions according to an embodiment. Some or all of the below-described exemplary hardware may be used to implement the controller 220. Referring to FIG. 5, a bus 528 serves as the main information highway interconnecting the other illustrated components of the hardware. CPU 502 is the central processing unit of the system, performing calculations and logic operations required to execute a program. Read only memory (ROM) 518 and random access memory (RAM) 520 constitute exemplary memory devices.

A disk controller 504 interfaces with one or more optional disk drives to the system bus 528. These disk drives may include, for example, external or internal DVD drives 510, CD ROM drives 506 or hard drives 508. As indicated previously, these various disk drives and disk controllers are optional devices.

Program instructions may be stored in the ROM 518 and/or the RAM 520. Optionally, program instructions may be stored on a computer readable medium such as a compact disk or a digital disk or other recording medium, a communications signal or a carrier wave.

An optional display interface 522 may permit information from the bus 528 to be displayed on the display 524 in audio, graphic or alphanumeric format. Communication with external devices may occur using various communication ports 526. For example, communication with the fill/exhaust valve 210, the cell valves 225*a*-N and the transducer 215 may occur via one or more communication ports 526.

In addition to the standard computer-type components, the hardware may also include an interface 512 which allows for receipt of data from input devices such as a keyboard 514 or other input device 516 such as a mouse, remote control, pointing device and/or joystick.

It will be appreciated that the above-disclosed and other features and functions, or alternatives thereof, may be desirably combined into many other different systems or applications. It will also be appreciated that various presently unforeseen or unanticipated alternatives, modifications, variations or improvements therein may be subsequently made by those skilled in the art which are also intended to be encompassed by the following claims.

What is claimed is:

1. A pneumatic compression device, comprising:

a compression pump configured to output a pressurized fluid via an output;

a fill/exhaust valve configured to connect the compression pump to one or more cell valves when in an open state, wherein the fill/exhaust valve is further configured to connect the one or more cell valves to the atmosphere when in a closed state;

a transducer, wherein the transducer is configured to sense a pressure level at the fill/exhaust valve;

a plurality of cell valves, wherein each cell valve corresponds to a cell, wherein each cell valve is configured to connect the fill/exhaust valve to the corresponding cell when in an open state; and a controller in communication with the transducer, the fill/exhaust valve and the plurality of cell valves, wherein the controller is configured to determine a state for each of the fill/exhaust valve and the plurality of cell valves based on at least the pressure level sensed by the transducer, wherein each state comprises one of an open state and a closed state, wherein each of the fill/exhaust valve and the plurality of cell valves comprises a portion of a first bore of a manifold and a portion of a second bore of the manifold, and wherein the manifold comprises a plurality of spacers, wherein each spacer is positioned on a distal side of a corresponding valve, wherein each spacer is operable to separate the portion of the second bore of the corresponding valve from the portion of the second bore of an adjacent valve or the atmosphere, wherein a spacer corresponding to the fill/exhaust valve is further operable to separate the portion of the first bore of the fill/exhaust valve from the portion of the first bore of the adjacent cell valve.

2. The pneumatic compression device of claim 1 wherein the pneumatic compression device is portable.

3. The pneumatic compression device of claim 1, further comprising:

a user interface in communication with the controller, wherein the user interface enables a user to provide information to the controller.

4. The pneumatic compression device of claim 3 wherein the information comprises information pertaining to one or more pressure thresholds.

5. The pneumatic compression device of claim 4 wherein each pressure threshold corresponds to at least one cell.

6. The pneumatic compression device of claim 4 wherein the controller is further configured to determine a state for one or more of the fill/exhaust valve and one or more cell valves based at least on a pressure threshold.

7. A pneumatic compression device, comprising:

a compression pump configured to output a pressurized fluid via an output of the compression pump; and a manifold, wherein the manifold comprises:

a first bore, a second bore, a plurality of valves, wherein a first valve of the plurality of valves comprises a fill/exhaust valve and a plurality of second valves of the plurality of valves comprise cell valves, wherein each valve of the plurality of valves comprises a portion of the first bore and a portion of the second bore, and a plurality of spacers, wherein each spacer is positioned on a distal side of a corresponding valve, wherein each spacer is operable to separate the portion of the second bore of the corresponding valve from the portion of the second bore of an adjacent valve or the atmosphere, wherein a spacer corresponding to the fill/exhaust valve is further operable to separate the portion of the first bore of the fill/exhaust valve from the portion of the first bore of the adjacent cell valve, wherein each valve is configured to connect the corresponding portion of the first bore to a valve output when the valve is in a first state, wherein each valve is configured to connect the corresponding portion of the second bore to the valve output when the valve is in a second state, wherein the portion of the first bore corresponding to the fill/exhaust valve is connected to the atmosphere, wherein the portion of the second bore corresponding to the fill/exhaust valve is connected to the output of the compression pump, wherein the valve output of the fill/exhaust valve is connected to the portion of the first bore of a cell valve.

8. The pneumatic compression device of claim 7 wherein the valve output of the fill/exhaust valve is connected to the portion of the first bore of a cell valve via tubing.

9. The pneumatic compression device of claim 7 wherein the valve output of each cell valve is connected to a corresponding cell.

10. The pneumatic compression device of claim 7, further comprising:

a controller configured to determine a state for each valve, wherein the state comprises one of the first state and the second state.

11. The pneumatic compression device of claim 10, further comprising:

a transducer in communication with the controller, wherein the transducer is configured to sense a pressure level.

12. The pneumatic compression device of claim 11 wherein the controller is configured to determine the state for each valve based on at least the pressure level sensed by the transducer.

* * * * *